United States Patent [19]

Matsuda

[11] 4,022,034

[45] May 10, 1977

[54] REINFORCEMENT FOR A TAPE EDGE OF A SLIDE FASTENER

[75] Inventor: Yoshio Matsuda, Nyuzen, Japan

[73] Assignee: Yoshida Kogyo Kabushiki Kaisha, Japan

[22] Filed: Oct. 14, 1975

[21] Appl. No.: 621,836

[30] Foreign Application Priority Data

Oct. 21, 1974 Japan ..... 49-126945

[52] U.S. Cl. ..... 66/169 R; 24/205 R

[51] Int. Cl.[2] ..... D04B 1/00; A44B 19/34

[58] Field of Search ..... 24/205, 16 R, 205.16 C; 66/169, 170, 190, 192, 193, 195, 1

[56] References Cited

UNITED STATES PATENTS

| | | | |
|---|---|---|---|
| 1,921,271 | 8/1933 | Lubin | 66/170 |
| 2,064,074 | 12/1936 | McNamee | 66/169 |
| 3,738,125 | 6/1973 | Blezard | 66/195 |

FOREIGN PATENTS OR APPLICATIONS

| | | | |
|---|---|---|---|
| 1,174,977 | 12/1969 | United Kingdom | 66/169 |

*Primary Examiner*—Henry S. Jaudon
*Attorney, Agent, or Firm*—Bucknam and Archer

[57] ABSTRACT

A reinforcement is provided for reinforcing a longitudinal edge of a stringer tape for a slide fastener, which reinforcement consists of an elongate core member and a tubular member holding the former centrally in place. The tubular member is a warp-knitted fabric formed by a Raschel or tricot double-needle knitting machine, the fabric having sinker loops interconnected with corresponding needle loops and urging the latter into fastening engagement with the core member.

2 Claims, 4 Drawing Figures

REINFORCEMENT FOR A TAPE EDGE OF A SLIDE FASTENER

BACKGROUND OF THE INVENTION

This invention relates generally to slide fasteners, more particlarly to reinforcements secured to a longitudinal edge of a stringer tape and adapted to mount thereon a row of interlocking elements of the fastener.

There have been proposed a number of tape edge reinforcements which are adapted to reinforce the tape edge along which the fastener elements are mounted and to provide positional stability of the latter during their coupling and uncoupling operation. Most widely used reinforcements were in the form of a plurality of yarns twisted or stranded substantially into a cross-sectionally circular configuration. The inherent drawback of this type of reinforcement is that it is susceptible to wear, rupture or other deformation when subjected to distorted stresses for instance as in the case where the reinforcement is held in vigorous contact with the fastener elements which are usually made of highly rigid materials such as metal or synthetic resin. Another known tape edge reinforcements was an elongate core enveloped by a weft-knit tubular fabric. However, due to the tendency of the weft-knitted fabric to expand and contact circumferentially of the tube, the core was liable to get loose and disunited therefrom. Thus, these prior-art reinforcements were not quite satisfactory for the purpose of retaining the fastener elements in the proper position and posture.

SUMMARY OF THE INVENTION

With the foregoing difficulties of the prior art in view, it is the primary object of the present invention to provide an improved reinforcement for a tape edge of a slide fastener which is capable of sufficient dimentional stability to retain the fastener elements in the proper position and posture over extended periods of use of the fastener.

Briefly stated, there is provided a tape edge reinforcement for a slide fastener which comprises a core member and a tubular member disposed in surrounding relation thereto, said tubular member consisting of a warp-knitted structure having needle loops and sinker loops interconnected therewith and urging said sinker loops into fastening engagement with said core member.

The invention will be better understood for the following description taken in conjunction with the accompanying drawing which illustrate a preferred embodiment which the invention may assume in practice and in which like reference numerals refer to like or corresponding parts throughout the different views.

DETAILED DESCRIPTION OF THE PREFERRED EMBODIMENT

Figure 1:
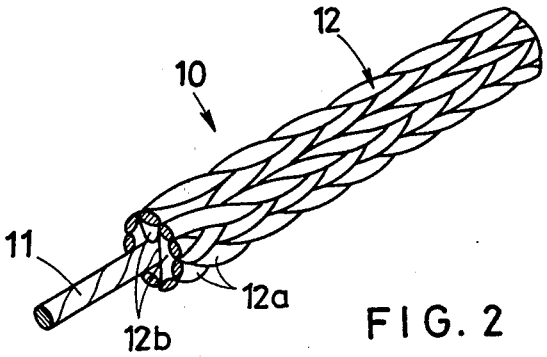
FIG. 1 is a perspective view of a tape edge reinforcement provided in accordance with the invention.

Referring now to the drawings and FIG. 1 in particular, there is shown a tape edge reinforcement 10 embodying the invention and comprising a core member 11 in the form of a twisted or stranded cotton or synthetic fiber yarn, a plastic filament, a metallic wire or the like, and a tubular, warp-knitted member 12 adapted to wrap around the core member 11.

According to an important feature of the invention, the tubular member 12 consists of a warp-knitted structure which is formed by a double needle knitting machine such as a double Raschel or a double tricot knitting machine and in which the needle loops **12*a* are fastened to and around the core member 11 by the sinker loops 12*b*. More specifically, this warp-knitted structure of the tubular member 12 is characterized by the arrangement in which the front and back sinker loops 12*b*, 12*b* extend warpwise in diagonally crisscrossed relation to each other and urge the respective needle loops 12*a*, 12*a* to clinch centrally around the core member 11 as the warp-knitting progresses. This may be accomplished by selecting the mode of operation of the machine in which the front and back guide bars are shogged symmetrically in opposite directions so that the two guide bar yarns form alternate underlaps and overlaps interconnected with the respective needle loops 12*a* and fastening the latter centrally to and around the core member 11 which is laid in as a warp thread where no shogging takes place. A typical example of design pattern of this warp-knitted structure is illustrated in FIG. 2, wherein the needle loops 12*a*** are shown to be in the form of closed laps, but these may be partly or wholly open laps.

Figure 2:
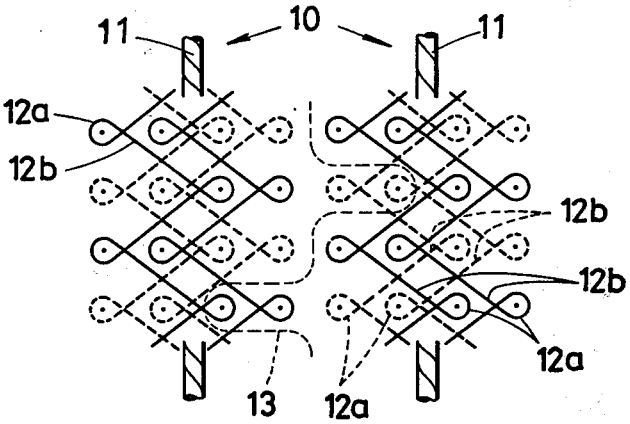
FIG. 2 is a schematic diagram illustrating a typical example of design pattern of warp-knitting employed according to the invention.

A close inspection of FIG. 2 shows that a plurality of reinforcements 10 are interconnected transversely in parallel by means of a connecting thread 13 which is laid in weftwise and which is preferably made of a water-soluble fiber so that by removing it in contact with water the interconnected reinforcements 10 can be conveniently separated into individual products.

Figure 3:
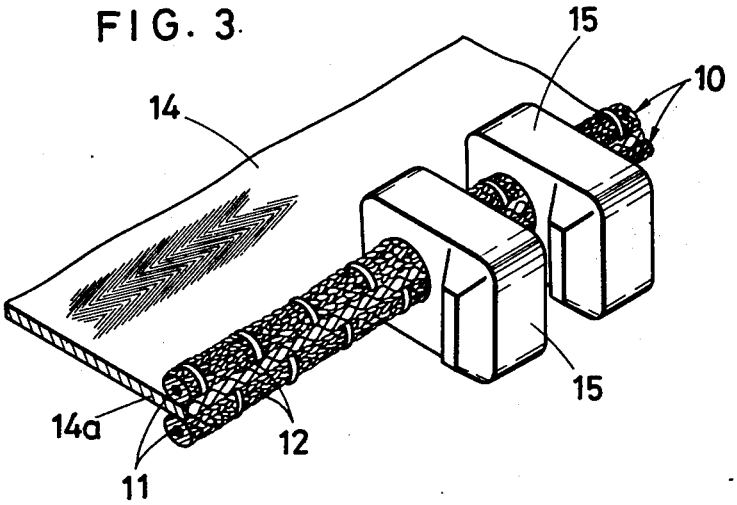
FIG. 3 is a fragmentary perspective view of a stringer tape to which the reinforcement of the invention is attached together with discretely formed fastener elements.

When applying the reinforcement 10 to a slide fastener, two of these may be mounted astride of and secured to a longitudinal edge **14*a* of a stringe tape 14 by means of weaving, knitting or sewing in the well known manner as shown in FIG. 3 wherein the fastener elements 15 in a discrete formation are clamped around the reinforcements 10 to the tape edge 14*a***.

Figure 4:
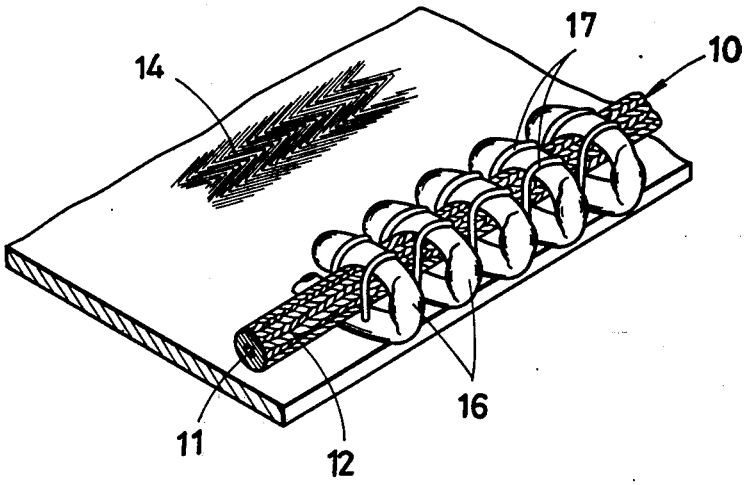
FIG. 4 is a fragmentary perspective view of a stringer tape to which the reinforcement is attached together with a continuously formed fastener element.

FIG. 4 illustrates the case where the reinforcement 10 is inserted through the longitudinally extending space of a continuously formed fastener element 16 such as in the form of a helical coil and secured together with the latter to one side of the tape 14 by means for example of sewing threads 17.

Since the reinforcement 10 according to the invention has the core member 11 completely surrounded uniformly by and fastened by the loops of warp-knitted yarns, the core member 11 is held stably in position against displacement or deformation which would otherwise take place in the longitudinal as well as in the circumferential direction of the core. Also advantageously, the warp-knitted structure of the tubular member 12 affords moderate hardness and uniform shape to the reinforcement 10, eliminating the tendency of the latter becoming flattened out or tilted which would otherwise result in misaligned or unstable fastener elements. Further advantageously, the tubular member 12 being constituted by uniformly warp-knitted loops can facilitate storage of the reinforcements 10 with greater ease than the conventional twisted yarns which must be sorted out right-hand twists from left-hand twists.

What is claimed is:

1. A tape edge reinforcement for a slide fastener which comprises an elongate core member and a tubular knitted fabric member disposed in circumferentially surrounding relation to said core member and extending longitudinally therewith, said tubular member consisting of a warp-knitted structure having needle loops and sinker loops interconnected therewith and urging said sinker loops into fastening engagement with said core member.

2. A tape edge reinforcement as defined in claim 1 wherein said sinker loops extend warpwise in diagonally criss-cross relation to each other and alternately over and under said needle loops.

* * * * *